United States Patent [19]

Popper

[11] 4,346,802

[45] Aug. 31, 1982

[54] COMBINATION ANTI-BRIDGING DEVICE AND VIBRATING TRAY

[75] Inventor: Jakhin B. Popper, Kyriat Motzkin, Israel

[73] Assignee: Popper Engineering Ltd., Kyriat Motzkin, Israel

[21] Appl. No.: 77,934

[22] Filed: Sep. 24, 1979

Related U.S. Application Data

[62] Division of Ser. No. 852,539, Nov. 17, 1977, abandoned.

[51] Int. Cl.[3] ..... B65G 47/44

[52] U.S. Cl. ..... 198/533; 222/200; 366/118

[58] Field of Search ..... 222/196, 198, 199, 200, 222/226, 243, 244, 245, 246, DIG. 1, 459, 189; 366/108, 113, 117, 118; 198/771, 533; 221/200-202; 209/244, 245, 262, 265, 320, 322, 325-330, 333-336, 341-343, 346-349, 920

[56] References Cited

U.S. PATENT DOCUMENTS

| | | | |
|---|---|---|---|
| 449,445 | 3/1895 | Henry et al. | 222/199 |
| 595,523 | 12/1897 | Cherry et al. | 209/348 X |
| 734,631 | 7/1903 | Stubbs | 222/200 |
| 786,291 | 4/1905 | Hubbell | 209/245 X |
| 936,051 | 10/1909 | Slichter | 222/243 |
| 2,619,090 | 11/1952 | Clausen | 222/200 X |
| 3,874,641 | 4/1975 | Tolan | 222/200 |

*Primary Examiner*—Robert J. Spar
*Assistant Examiner*—Fred A. Silverberg
*Attorney, Agent, or Firm*—Browdy and Neimark

[57] ABSTRACT

A device for preventing bridging of bulk material in the form of powder or granules during discharge from a storage container or during handling, comprising apparatus for applying a shearing force to the bulk material along an axis orthogonal to the flowpath direction axis and without appreciably compacting the bulk material.

3 Claims, 18 Drawing Figures

COMBINATION ANTI-BRIDGING DEVICE AND VIBRATING TRAY

This is a division of application Ser. No. 852,539 filed Nov. 17, 1977, now abandoned.

FIELD OF THE INVENTION

The present invention relates to materials handling and storage apparatus and in particular to containers for bulk storage of materials designed for gravity unloading.

BACKGROUND OF THE INVENTION

Bulk products, including powders or granulates such as flour, sand and coffee, as well as larger items such as nuts or potatoes are often stored in large containers and unloaded therefrom through egress openings in the bottom of the containers. Such containers are often designed to have very steep walls adjacent the egress opening to aid the outward flow of the bulk material. Nevertheless the material often becomes clogged and will not flow out of the container. This phenomenon is generally termed "bridging" since the bulk material tends to assume a curved or cupola-like shape. It is known that sometimes vibrating or knocking the container walls from outside is sufficient to "break the bridge" of bulk material and enable the flow to recommence. Sometimes, however, such vibrating or knocking results in container wall vibrations which further compact the material resulting in an even more rigid and indestructable bridge being formed.

It is believed that the particles of bulk material tend to interact in a self-locking position. The mechanical definition of self-locking refers to a situation wherein particles cannot move relative to each other in the direction of an applied driving force component, such as gravity, due to the presence of a force such as a frictional force component which is larger than the driving force component and normal thereto and which urges the particles against each other. The frictional force component that holds the particles together is proportional to the coefficient of friction of the particular bulk material. Thus, materials having relatively large coefficients of friction have a relatively large tendency to bridge.

Most materials, however, when in motion are known to have a relatively smaller coefficient of friction than at rest. The present invention appreciates this fact and endeavours to reduce the coefficient of friction between bulk particles by producing relative motion therebetween.

SUMMARY OF THE INVENTION

There is thus provided in accordance with the present invention, an apparatus for use with a container for storage and handling of goods in bulk having an egress opening for discharge of the bulk goods therefrom, and having defined at each location therein a flowpath direction along which the bulk goods travel within the container en route to the egress opening, an anti-bridging device comprising: apparatus for applying a shearing force to said bulk material along an axis orthogonal to the flowpath direction axis and without appreciably compacting said bulk material.

In accordance with a preferred embodiment of the present invention, the means for applying a shearing force comprises at least one plate member and means for causing vibration of said at least one plate member parallel to the plane of said at least one plate member and mainly along an axis perpendicular to said flowpath direction axis.

BRIEF DESCRIPTION OF THE DRAWINGS

The invention will be more fully appreciated and understood from the following detailed description taken in conjunction with the drawing in which.

DETAILED DESCRIPTION OF PREFERRED EMBODIMENTS

Figure 1:
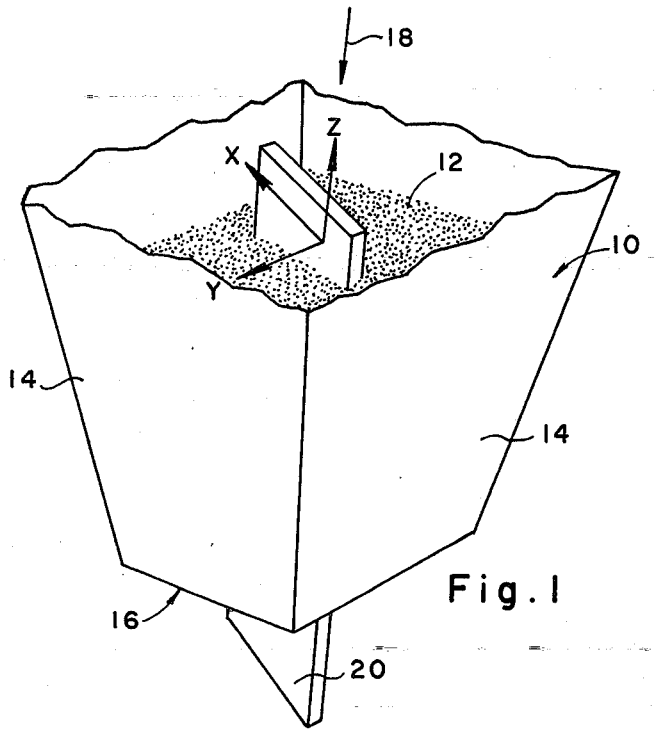
FIG. 1 is a partially cut away pictorial view of an anti-bridging device constructed and operative in accordance with an embodiment of the invention.

Referring now to FIG. 1 there is shown the lower portion 10 of a container in which is disposed bulk material 12, such as flour, sand, nuts or potatoes. Container portion 10 is formed with tapered side walls 14 and serves as a conduit between an upper portion of the container (not shown) disposed above portion 10 and an egress opening 16. Egress of the bulk material 12 from the container normally results from the action of gravity which, in the embodiment illustrated in FIG. 1 produces a force component along the direction indicated by arrow 18 and parallel to the Z-axis illustrated in FIG. 1. According to an alternative embodiment of the invention, egress of the bulk material need not be produced by gravity but may be instead produced by positive pressure or suction applied to the bulk material.

It is known that bridging of bulk material such as bulk material 12 often occurs in the course of egress via a tapered container portion such as container portion 10. In order to eliminate bridging or at least greatly to reduce its incidence there is provided within container portion 10 a planar member 20 which is disposed generally along the X-axis. The X-axis may form any desired angle with respect to walls 14 of container 10. Planar member 20 is caused to move in periodic or aperiodic translational or rotational motion or any combination thereof in directions in the X-Z plane which are selected to be mainly orthogonal to the Z-axis by apparatus as that shown in FIG. 7 and indicated by reference numeral 102. Motion of plate 20 in directions along the Y-axis relative to container portion 10 are minimized insofar as possible in order to avoid compression of the bulk material between the planar faces of plate member 20 and the side walls 14. Such compression clearly enhances the tendency of the bulk material to bridge rather than reducing it as is desired. The motion of plate member 20 in directions along the X-axis produces a shearing effect on the particles of bulk material 12 adjacent plate 20 thereby imparting motion thereto and thus reducing their coefficient of friction. The shearing effect of motion of plate 20 along directions parallel to the X-axis may be enhanced by surface conditioning of plate 20 such as knurling, grooving, etc.

It is appreciated that significant motion of plate member 20 in directions along the Z-axis will have deleterious effects in that during the downward portion of that motion in a direction indicated by arrow 18 the movement of plate member 20 will increase the downward vertical pressure and tend to compact the material further due to increased normal forces resulting from the curved bridge configuration of the compacted material. Nevertheless, in practice, relatively small components of motion in direction 18 may be tolerated.

Figure 2:
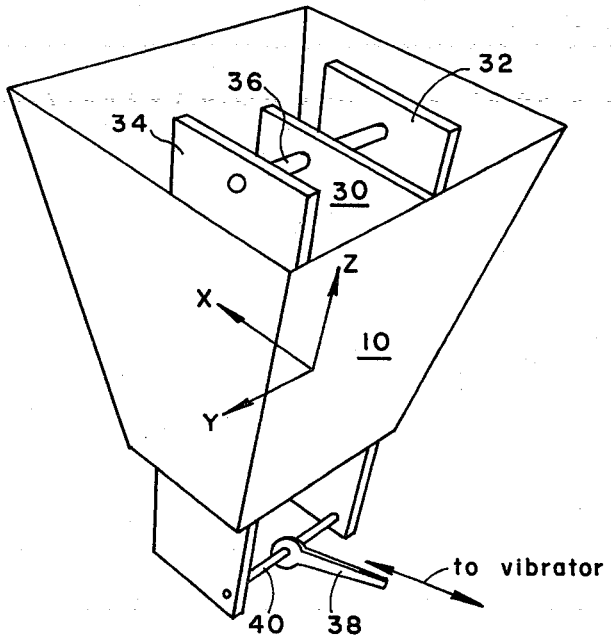
FIG. 2 is a schematic illustration of an anti-bridging device constructed and operative according to an alternative embodiment of the invention.

Referring now to FIG. 2 there is shown an alternative embodiment of the apparatus in FIG. 1 in which a stationary plate 30 is mounted within container portion 10. Vibrating plates 32 and 34 are rotably mounted on a shaft 36 in generally parallel equidistant relationship on either side of plate 30 disposed generally in the X-Z plane. Vibration of plates 32 and 34 in directions in the X-Z plane is produced by vibrating means (not shown) coupled to plates 32 and 34 by means of a drive shaft 38 rotatably coupled to a mounting support 40 which is in turn coupled to the bottom portions of respective plates 32 and 34. In accordance with the embodiment of the invention shown in FIG. 2, plates 32 and 34 move in generally the same direction in phase with each other and relative to stationary plate 30.

Figure 3:
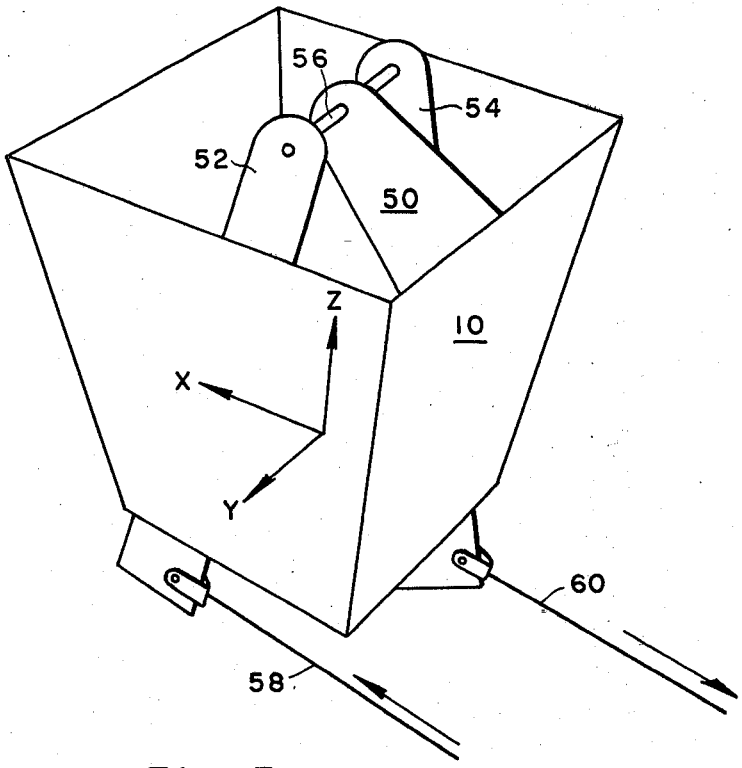
FIG. 3 is a schematic illustration of an anti-bridging device constructed and operative in accordance with a still further embodiment of the invention.

Referring now to FIG. 3 there is shown an alternative embodiment of the invention in which a stationary mounting plate 50 is fixedly disposed within container portion 10. A pair of vibrating plate members 52 and 54 are rotatbly mounted into stationary plate 50 by means of a shaft 56. Driving means (not shown) coupled to respective plate members 52 and 54 by means of coupling members 58 and 60 cause the plate members to move in relative out of phase motion.

Figure 4:
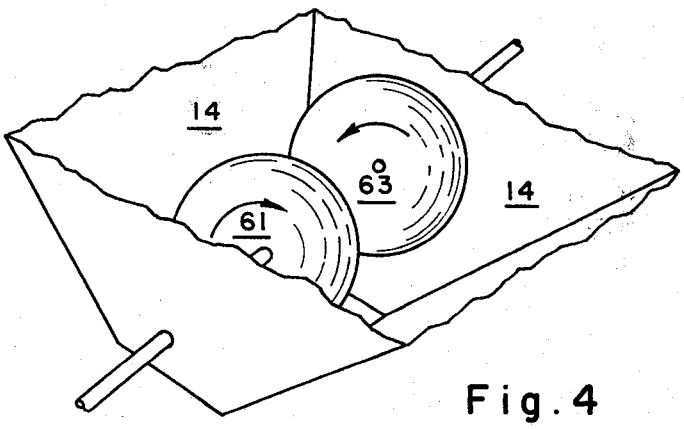
FIG. 4 is a schematic illustration of an anti-bridging device constructed and operative in accordance with a yet further embodiment of the invention.

Referring now to FIG. 4 there is shown an alternative embodiment of the invention in which discs 61 and 63 are rotated about their respective axes in opposite directions. According to further alternative embodiments, discs 61 and 63 may rotate in the same direction or about the same or different axes. As a further alternative one or more discs may be provided in any suitable configuration.

Figure 5:
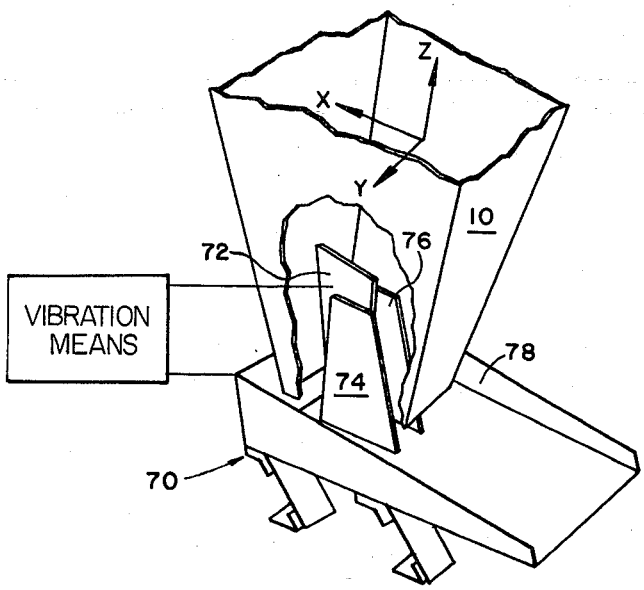
FIG. 5 is a schematic illustration of a combination bridging device and vibrating tray disposed for operation adjacent the egress opening of a container.

Referring now to FIG. 5 there is shown a vibrating tray assembly 70 disposed adjacent and below the egress opening of container portion 10. A plate 72 is fixedly mounted to container portion 10 and disposed generally in the X-Z plane. A pair of vibrating plates 74 and 76 disposed on either side of, parallel and generally equidistant to plate 72 are fixedly mounted to tray 78 of the vibrating tray assembly 70 for vibration therewith. The combination thus illustrated produces an anti-bridging action within the confines of container portion 10 and aids in the removal of material therefrom by causing movement of such material in a direction away from container 10 in a conventional manner characteristic of known vibrating tray assembles.

Figure 6:
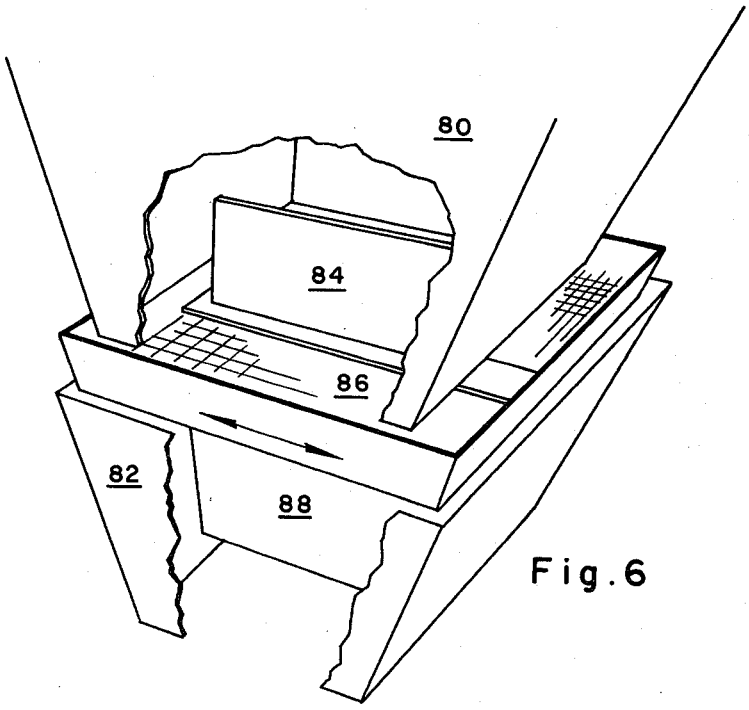
FIG. 6 is a partially cut away schematic illustration of a combination vibrating screen and anti-bridging device disposed intermediate an upper container and a lower container.

Reference is now made to FIG. 6 in which a vibrating screen mesh anti-bridging device is shown disposed between an upper container 80 and a lower container 82. In the pictorial illustration provided, a first plate 84 is coupled to the vibrating screen 86 and a second plate 88 which may be disposed below screen 86 and thus on the opposite side of the screen from plate 84 but need not be so disposed, is coupled to a balancing mass, not shown, which vibrates in out-of-phase relationship to screen 86. The relative vibrational motion between screen 86 and the balancing mass and thus between respective plates 84 and 88 is produced by driving means (not shown). Alternatively, plates 84 and 88 may be arranged to move in an in-phase relationship.

Figure 7:
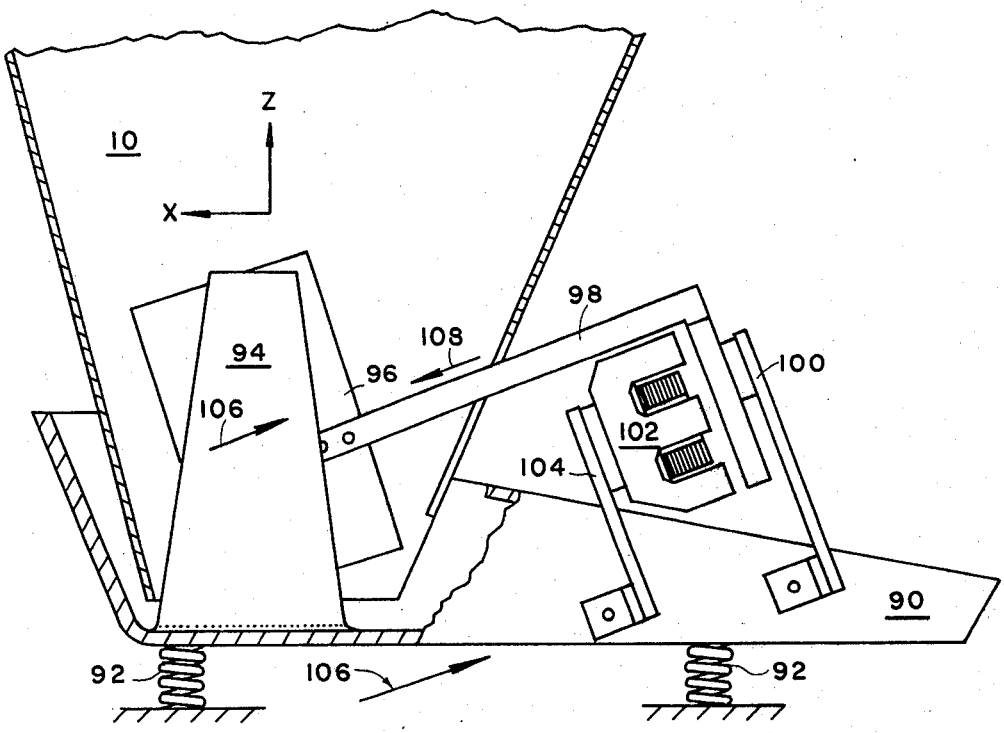
FIG. 7 is a schematic sectional illustration, partially cut away, of a combination anti-bridging device and vibrating tray constructed and operative in accordance with an embodiment of the invention.

Referring now to FIG. 7 there is shown an exemplary embodiment of the anti-bridging device-vibrating tray combination similar to that illustrated in FIG. 5 hereinabove. Tray 90 is mounted on coil springs 92 which are in turn fixed with respect to the ground. A pair of plates 94, (only one of which can be seen in FIG. 7) are fixedly mounted on tray 90 and extend within the volume defined by container portion 10. Plates 94 are generally disposed in the X-Z plane and an armature plate 96 is disposed, also in the X-Z plane equidistant between plates 94 for motion relative thereto. Armature plate 96 is coupled via a mounting element 98 to one end of the set of armature springs 100, the upper end of which is fixedly coupled to tray 90. An AC electromagnet 102 is mounted at an extreme end of a similar set of springs 104 hereinafter termed magnet mounting springs, the opposite extreme ends of which are also fixedly mounted to tray 90. Electromagnet 102 is disposed for operative association with a portion of mounting element 98. In response to the receipt of an AC electrical current, magnet 102 is operative to apply an AC force to element 98 causing vibratory motion of that element and thus of element 96 relative to magnet 102 and to tray 90. Armature plate 96, being fixedly mounted to element 98, is thus placed in motion with respect to plate members 94 which are fixed with respect to tray 90 and also with respect to container portion 10 which is independently mounted with respect to tray 90 and does not vibrate together therewith. Vibration of the tray and plates 94 is generally along an axis indicated by arrow 106 and vibration of the armature plate relative thereto occurs in a parallel direction indicated by arrow 108.

Figure 8:
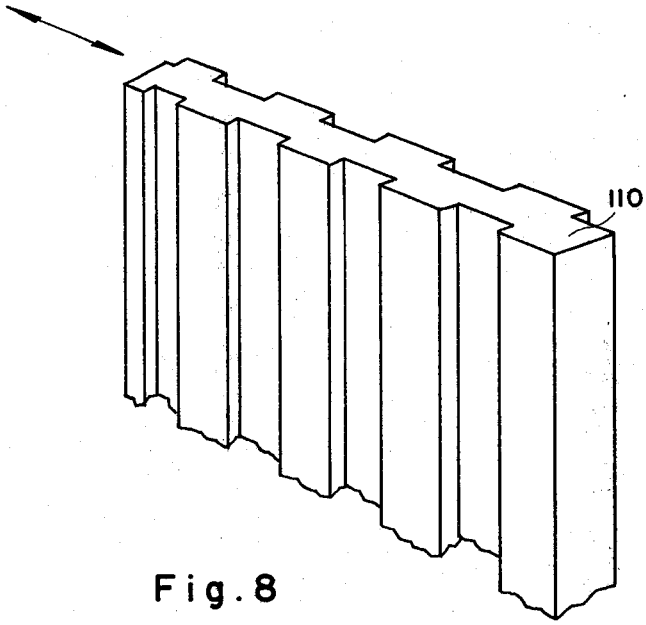
FIG. 8 is an exemplary illustration of a plate having conditioned surfaces and suitable for use with a vibrating plate in accordance with an embodiment of the invention.

Referring now to FIG. 8 there is seen an exemplary illustration of a plate member 110 having a conditioned surface for enhancement of shearing properties. It is appreciated that the conditioning of the planar surfaces of plate member 110 may take any suitable form such as channelling, knurling or grooving.

Figure 9:
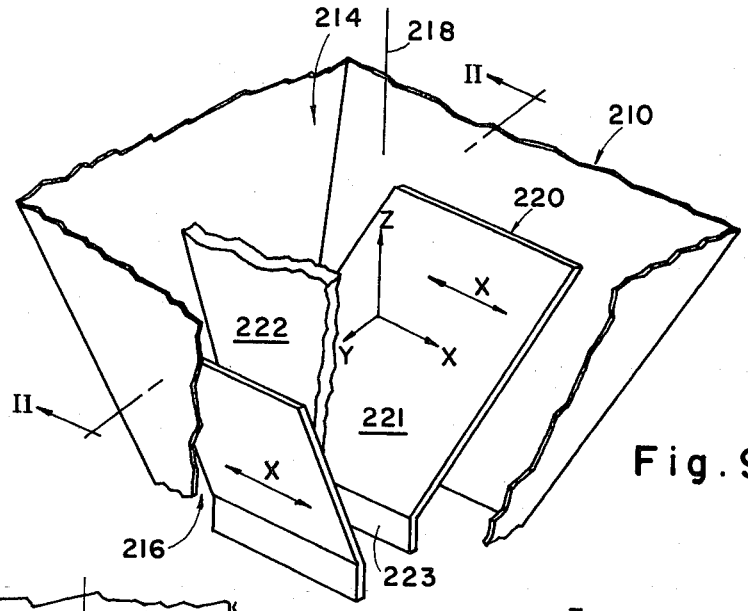
FIG. 9 shows an anti-bridging device constructed and operative in accordance with an embodiment of the invention.
Figure 10:
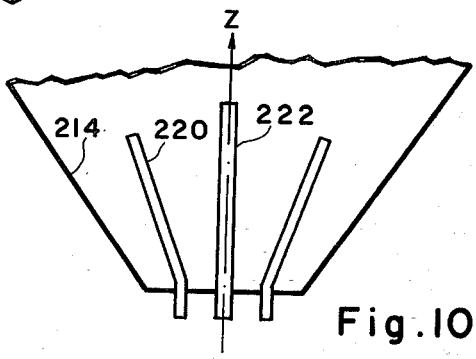
FIG. 10 is a sectional view of the apparatus of FIG. 9 taken along the lines II—II.

Referring to FIGS. 9 and 10 there is shown the lower portion 210 of a container in which may be disposed bulk material such as flour, sand, nuts, potatoes or peanuts. Container portion 210 is formed with tapered side walls 214 and serves as a conduit between an upper portion of the container (not shown) disposed above portion 210 and an egress opening 216. Egress of bulk material from the container normally results from the action of gravity which, in the embodiment illustrated in FIGS. 9 and 10, produces a force component generally along the direction indicated by an arrow 218 and parallel to the Z axis illustrated in FIG. 9. The direction of flow of the bulk material is determined as a function of its position within container portion 210. A range of flowpath directions is defined and limited by the angles at which the respective side walls 214 are inclined with respect to the Z-axis. The flowpath direction of a given particle depends on the relative distance between it and the center Z-axis and walls 214 respectively. According to an alternative embodiment of the invention, egress of the bulk material need not be produced by gravity but instead may be produced by positive pressure or suction applied to the bulk material.

It is known that bridging of bulk material often occurs in the course of egress via a tapered container portion such as container portion 210. In order to eliminate bridging or at least greatly to reduce its incidence there is provided within container 210 a pair of driven members 220 of extended surface area disposed adjacent walls 214 of container portion 210 and coupled to driving means (not shown) for motion generally parallel to their surface.

In the embodiment shown there is also provided a stationary wall portion 222 which is fixed in generally parallel relationship to driven members 220 to at least one wall 214 of container portion 210. Alternatively, the stationary wall portion may be omitted.

Members 210 are each formed of first and second planar elements 221 and 223 which are angled with respect to each other so as to conform generally to the shape of the container portion 210. The configuration of members 220 is selected such that plates 220 are disposed adjacent walls 214 and along the flowpath direction of the material. As seen in FIG. 10 the angular disposition of plates 220 is intermediate the Z-axis and the plane defined by the adjacent side walls. This disposition is selected in order that shearing force is applied to particles which tend to collect adjacent walls 214 and to minimize resistance to particle flow along the flowpath direction and thus to minimize compacting of the bulk material.

Figure 11:
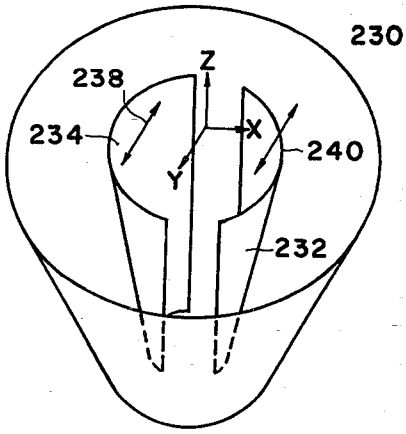
FIG. 11 shows an anti-bridging device constructed and operative in accordance with a further embodiment of the invention.

Referring now to FIG. 11 there is shown anti-bridging apparatus disposed within a container portion 230 formed in the shape of a truncated conus. First and second curved members 232 and 234 are disposed within container portion 230 for vibration therein in directions generally perpendicular to the Z-axis. The curvature of members 232 and 234 in the X-Y plane is selected to complement the curvature of the wall surface of container portion 230 and the angular disposition of members 232 and 234 is selected to be intermediate the Z-axis and the angular disposition of the walls of container 230 such that the surfaces of members 232 are disposed generally along the flowpath direction of the bulk material adjacent thereto. The surfaces of members 232 are arranged to be vibrated along directions indicated by arrows 238 and 240 which lie generally along the Y-axis. Alternatively, members 232 may be reciprocally rotated in the X-Y plane and parallel to the confronting walls of the container portion 230.

Figure 12:
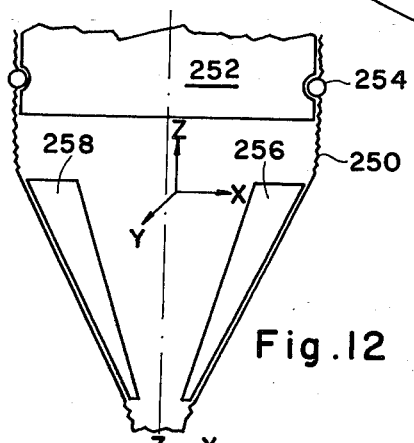
FIG. 12 is a sectional view of apparatus constructed and operative in accordance with another embodiment of the invention.

Referring now to FIG. 12 there is shown anti-bridging apparatus similar to that illustrated in FIG. 11 disposed within a container portion 250 formed of cloth or other suitable flexible material which is retained in position at the exit opening of a container 252 by means of a retaining ring 254. The anti-bridging apparatus, similarly to that shown in FIG. 11 comprises a pair of curved plate members 256 and 258 which are vibrated in directions along the Y-axis so as to produce a shearing force along the flowpath direction of the adjacent bulk material to bulk material lying adjacent thereto and between the wall portions of container portion 250 and the confronting curved plate members.

Figure 13:
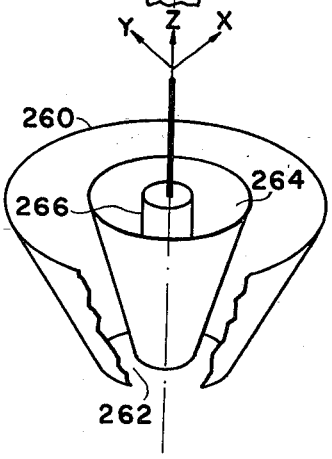
FIG. 13 is a partially cut away pictorial view of yet another embodiment of the invention.

There is shown in FIG. 13 anti-bridging apparatus adapted for rotational motion relative to a container. A container portion 260 of truncated conical configuration defines an egress opening 262. A shearing force imparting member 264, comprising a hollow truncated cone which defines a solid angle smaller than that defined by container 260, is disposed coaxially with container 260 and adapted for rotational movement driven by means (not shown) about the Z-axis relative to container 260. Such motion may be continuous or reciprocal or any suitable combination of motions in the X-Y plane. A stationary member 266 may be disposed coaxially with member 264 and therewithin to enhance the provision of shearing force to bulk material traversing container portion 260.

Figure 14:
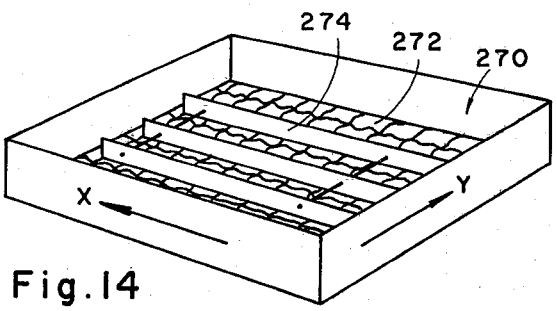
FIG. 14 is a pictorial illustration of an anti-bridging screen constructed and operative in accordance with an embodiment of the invention.

An anti-bridging screen device is shown schematically in FIG. 14 and comprises a support structure 270 within which is mounted a sifting grid 272. An array of elongate planar members 274 is suspended independently of grid 272 by support means (not shown) or alternatively merely left to "float" in the material above the grid. The grid is typically vibrated either in the X or Y directions producing a reciprocal displacement of grid 272 relative to the array of members 274 with the result that a shearing force is produced on the particles in the vicinity of the grid interstices which combats the tendency of the bulk material to bridge. In cases where a bulk material, such as peanuts, is particularly sensitive to impact, the relative vibration typically occurs along the axis of elongate members 274 and thus in the embodiment of the invention illustrated, along the X-axis.

Figure 15A:
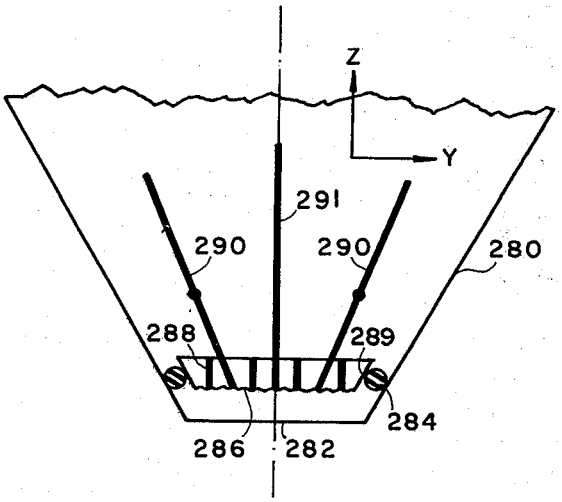
FIG. 15A is a sectional view of a valve mechanism constructed and operative in accordance with an embodiment of the invention and FIG. 15B is a pictorial view of the mechanism of FIG. 15A, partially constructed.
Figure 15B:
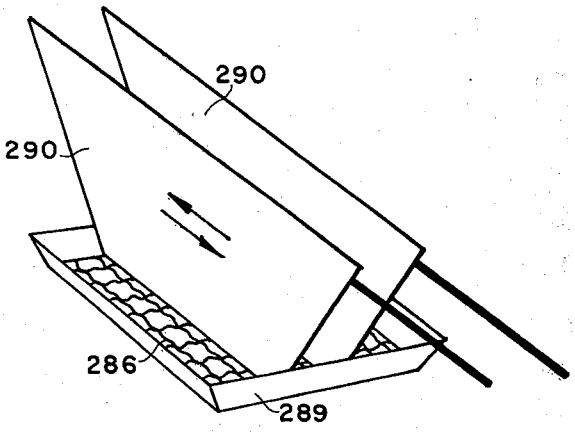

Referring to FIGS. 15A and 15B there is shown a flow valve disposed adjacent the egress opening 282 of a tapered container portion 280. The valve comprises a sifting grid 286 with relatively small interstices mounted on a frame 289 which is in turn surrounded by and sealed with respect to the inner periphery of container portion 280 by a resilient seal 284 typically formed of rubber or other suitable material. Grid 286 may be similar in all relevant respects to grid 272 (FIG. 14). A plurality of upstanding anti-bridging elements including relatively narrow elements 288 and a centrally disposed wide element 291 are disposed above grid 286 for vibration relative thereto. Elements 288 or 291 may be fixed to container portion 280 or alternatively "floated" in the bulk material above grid 286. A plurality of relatively wide elements 290 is disposed above grid 286 and fixed to frame 280 as shown in FIG. 15B. In the illustrated embodiment, vibratory motion is transmitted to members 290 from an external source by means (not shown). The frequency and amplitude of the vibration may be selected to govern the amount of flow through egress opening 282. If vibration is terminated altogether there results a termination in the flow of bulk material from egress opening 282.

Figure 16:
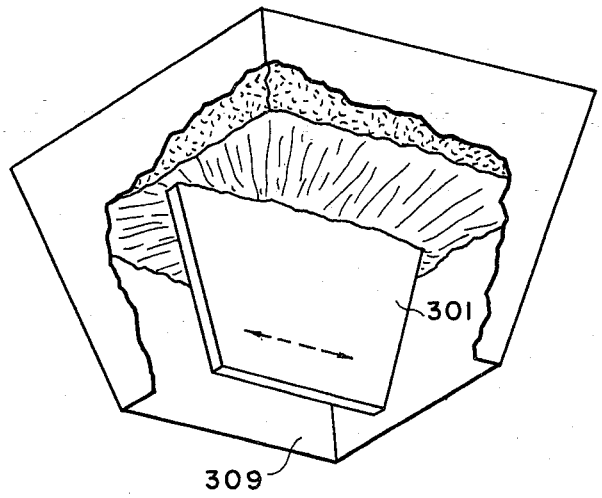
FIG. 16 shows a bridge formed and holding fast inspite of the vibrating plate.
Figure 17:
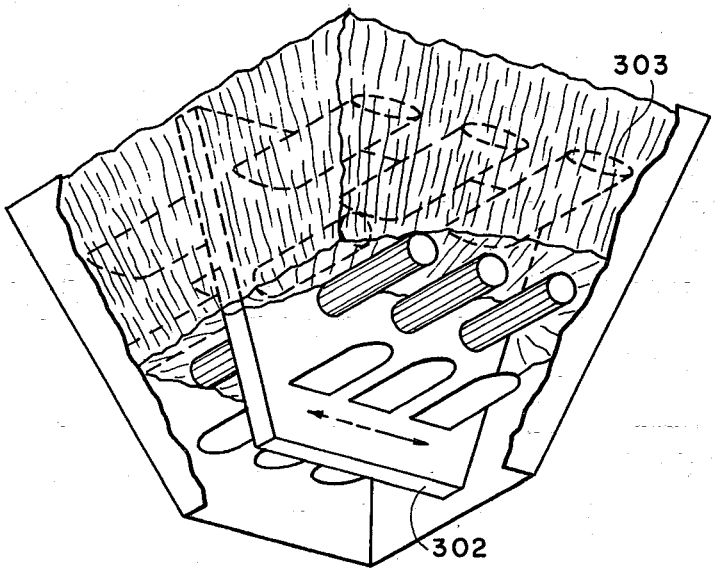
FIG. 17 shows teeth alongside the plate that break the arch formed as per FIG. 16.

Reference is now made to FIGS. 16–17 which relate to materials with an extreme tendency to bridging such as sticky casting sands (that must hold together in the casting form) or oily dried foods etc. In those cases the vibrating plates described above may not suffice to break the "bridges" as will be explained hereunder.

The above description does not relate to the driving mechanism of such anti-bridging plates. If it is a rod activating the plate through a hole in the container walls there may arise a severe sealing problem which might cause waste of material and contamination of the surroundings through these holes.

The present embodiments reveal how bridges of very sticky materials can be broken and how bodies inside high silos can be vibrated radially sideways by a vertical driving mechanism at the top of the silo.

Referring to FIG. 16 that explains how in spite of one of the four bridge pillows being broken by vibrating plate 301, the bridge still holds strong, leaning against the container walls 309.

However, as soon as the vibrating toothed plate 302 (FIG. 17), cuts into the arch, it causes an avalanche of the bridged material which then flows towards the bins egress. The teeth 303 may be welded to or cast with plate 302; they may be of round, flat or oval shape as shown.

It will be appreciated by those skilled in the art that the embodiment shown and described hereinabove are merely exemplary of a wide range of apparatus which may be constructed in accordance with the teachings of the present invention. Therefore the invention is limited only by the claims which follow.

I claim:

1. Apparatus for preventing bridging of bulk material in a housing for storing or handling goods in bulk, the housing having an egress opening for discharge of the goods therefrom and having defined therein a flowpath direction axis along which the goods travel within the housing en route to the egress opening when in use, the apparatus comprising:

flow discharge control means for preventing bridging of the goods during travel thereof through the housing, said flow discharge control means comprising a first unitary generally flat plate disposed along said flowpath direction axis, at least a part of said plate being within the housing when in use;

vibration means for causing vibration of said plate relative to the housing along a vibration axis parallel to said plate and substantially perpendicular to said flowpath direction axis in longitudinal reciprocal motion, thereby applying a shearing force to the goods along an axis orthogonal to the flowpath direction axis without appreciably compacting the goods; and a tray disposed in operative association with the egress opening of the housing downstream thereof and extending outwardly therefrom, said tray being arranged for vibration generally parallel to the plane thereof for urging said goods away from said egress opening in an outflow direction, wherein said unitary generally flat plate is fixedly connected to said tray and arranged such that the plane of said plate lies generally parallel to said outflow direction and wherein said vibration means are connected to said tray, thereby causing vibration of said tray and said plate along an axis parallel to said outflow direction and thus producing a combined anti-bridging action within the confines of said housing and a removal action of goods from the housing along said tray.

2. Apparatus according to claim 1 and wherein said tray is arranged to define a sloping surface having a downwardly extending gradient in a plane extending parallel to said vibration axis.

3. An apparatus in accordance with claim 1 wherein said flow discharge control means further includes a second unitary generally flat plate disposed along said flowpath direction axis parallel to said first plate, at least a part of said second plate being within the housing when in use, said second plate not being fixedly connected to said tray, and wherein said vibration means is further connected to said second plate so as to cause said second plate to vibrate out-of-phase relative to said first plate, thereby producing out-of-phase vibratory motion between said first and second plates.

* * * * *